US006487983B1

(12) United States Patent
Jönsson et al.

(10) Patent No.: US 6,487,983 B1
(45) Date of Patent: Dec. 3, 2002

(54) MONITORING SYSTEM

(75) Inventors: Nils Jönsson, Täby (SE); Mats Dahlgren, Stocksund (SE)

(73) Assignee: Nira Automotive AB, Sundbyberg (SE)

( * ) Notice: Subject to any disclaimer, the term of this patent is extended or adjusted under 35 U.S.C. 154(b) by 0 days.

(21) Appl. No.: 09/806,830

(22) PCT Filed: Oct. 6, 1999

(86) PCT No.: PCT/SE99/01783

§ 371 (c)(1),
(2), (4) Date: Jun. 4, 2001

(87) PCT Pub. No.: WO00/21054

PCT Pub. Date: Apr. 13, 2000

(30) Foreign Application Priority Data

Oct. 6, 1998 (SE) ..... 9803391

(51) Int. Cl.[7] ..... B63H 25/00
(52) U.S. Cl. ..... 114/144 R
(58) Field of Search ..... 114/144 R; 440/84, 440/85, 86, 87, 1, 2

(56) References Cited

U.S. PATENT DOCUMENTS 4,589,132 A * 5/1986 Botbol et al. ..... 704/274
5,054,569 A 10/1991 Scott et al.
5,362,269 A * 11/1994 Leach ..... 114/144 R
5,870,673 A * 2/1999 Haartsen ..... 455/426

FOREIGN PATENT DOCUMENTS

| | | |
|---|---|---|
| DE | 41 06 634 | 9/1992 |
| DE | 195 03 829 | 8/1996 |
| DE | 195 09 092 | 9/1996 |
| FR | 2 666 922 | 3/1992 |
| WO | WO97/39924 | 10/1997 |

* cited by examiner

*Primary Examiner*—Stephen Avila
(74) *Attorney, Agent, or Firm*—Nixon & Vanderhye

(57) ABSTRACT

The monitoring system includes a central unit for sending and receiving wireless information concerning events and conditions on a boat or components arranged on the boat. A portable remote manoeuvre unit is equipped to send wireless instructions to the central unit and to receive wireless information from the central unit. The portable manoeuvering unit includes a manoeuvering device and a gear changing device for sending wireless instructions to change the gears of the boat, to adjust the throttle controls of the boat and to control its steering.

10 Claims, 2 Drawing Sheets

MONITORING SYSTEM

The present invention relates to a monitoring system for boats, comprising a central unit installed on the boat which is equipped to send wireless information concerning events and conditions on the boat and/or components arranged on the boat and to receive wireless instructions to control the components arranged on the boat; and a portable manoeuvre unit which is equipped to send wireless instructions to the central unit installed on the boat.

When boats lie moored they are often left without supervision. It is therefore of interest that they can be monitored. According to current technology this can be done with a burglar alarm, which gives a warning signal if a break in or an attempted break in happens on the boat. Such an existing burglar alarm is activated and deactivated with a portable, hand held manoeuvre unit which sends instructions by radio to the central unit arranged on the boat.

It is also of interest to monitor other events and conditions on the boat or the components arranged on the boat. These events and conditions can be ingress of water into the boat, fire on the boat, battery voltage etc.

The events which occur and the conditions on the boat which are changed must often be attended to promptly, and for this reason it is important that the owner of the boat or other person responsible for the boat is informed as soon as possible.

If the owner of the boat or other person responsible for the boat is at some distance from the boat it is desirable that the events and conditions can be promptly attended to at a distance from the boat.

Monitoring systems for boats available on the market do not satisfy the need which currently exists of obtaining an overall monitoring of the boat.

It is therefore an objective of the present invention to provide a monitoring system for boats which gives information by radio concerning the events and conditions on the boat and which monitoring system permits the events on the boat to be acted on wireless.

Another objective is to provide a monitoring system for boats where the events and conditions on the boat can be acted on by a person who is located some distance from a steering area on the boat.

A further objective is to provide a monitoring system for boats which permits control of the boat or components arranged on the boat.

A further objective is to provide a monitoring system for boats which permits increased safety for users of the boat.

This is achieved by means of a monitoring system of the type presented in the introduction where the portable manoeuvre unit is equipped to receive wireless information from the central unit.

Such a monitoring system allows increased flexibility for the users of the boat. By sending instructions and receiving wireless information, the users of the boat are not restricted to be in the vicinity of the boat, or be located on board, in order to receive information about events and conditions on the boat.

By means of a preferred embodiment, a number of functions can be acted on or controlled with the portable manoeuvre unit. In addition to controlling a burglar alarm arranged on the boat, the portable manoeuvre unit can be used, for example, to start and warm up the boat's engine. It is also possible to manoeuvre the boat via the portable manoeuvre unit. This means that the user does not need to be positioned at the steering area of the boat to manoeuvre the boat.

The monitoring system can advantageously operate in conjunction with a digital serial busbar arranged on the boat to form a network with the other components on the boat, such as a CAN-network (CAN-Controller Area Network). By coupling the monitoring system to the CAN-network, virtually all electrical installations on the boat can be reached. By providing the boat's diesel engine with a control system of the EDC type (EDC-Electronic Diesel Control) and connecting this control system to the CAN-network, the engine can also be controlled by the monitoring system via the CAN-network. If the monitoring system is in contact with the EDC-system, a stalt-lock can be activated. When the start-lock is activated, the engine can not be started.

The invention is more precisely described by means of an example of an embodiment and the appended figures.

Figure 1:
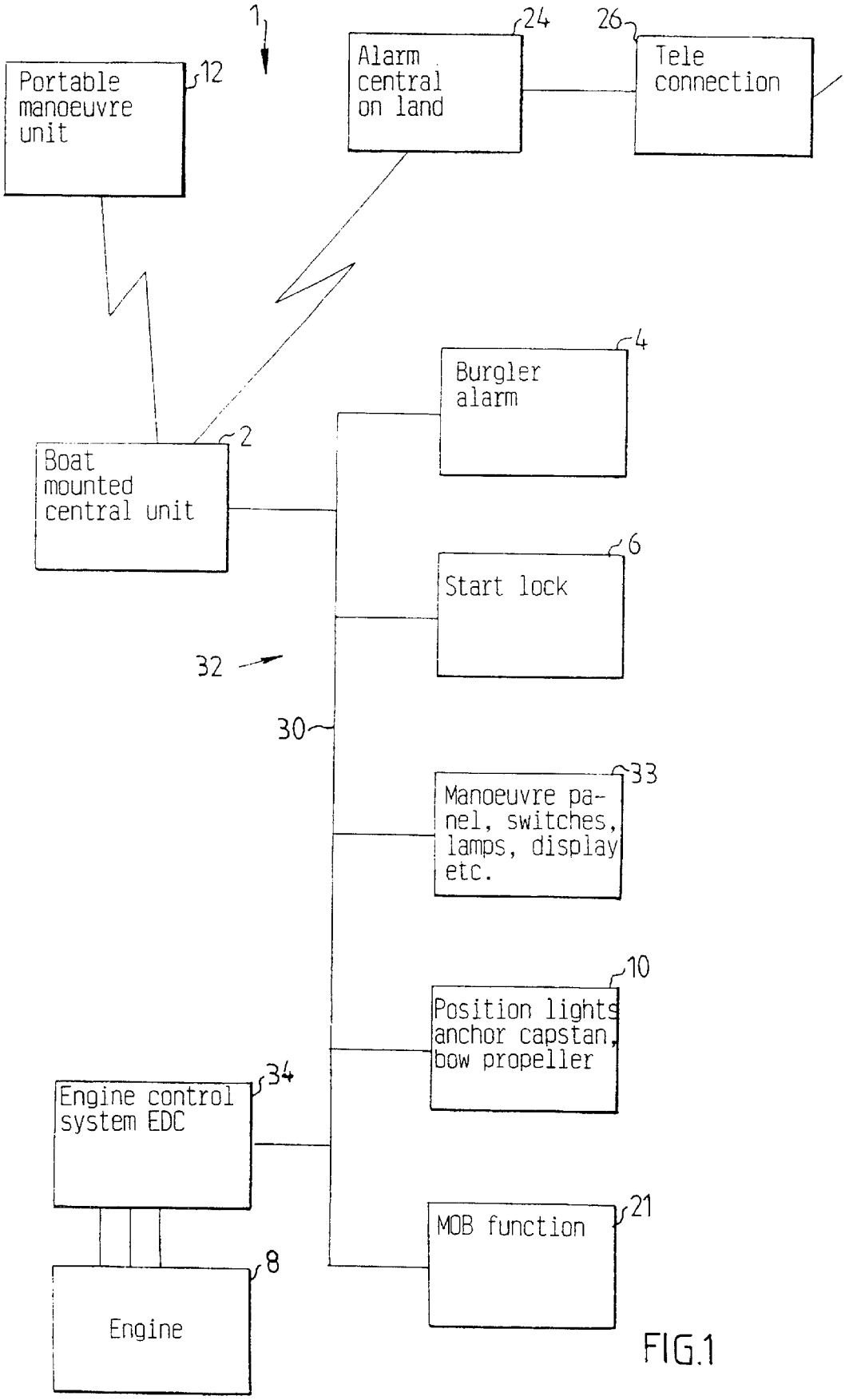
FIG. 1 shows, in a block diagram, an example of an embodiment regarding a monitoring system according to the present invention.

A monitoring system according to the invention is shown in FIG. 1. The reference numeral 2 refers to the fixed central unit mounted on the boat. The central unit 2 is so equipped that it can send wireless information concerning the events and conditions on the boat and/or components arranged on the boat, and receive wireless instructions to control the components arranged on the boat. The components which can be controlled are, for example, a burglar alarm 4 and/or a start-lock 6 for an engine 8 arranged on the boat. It can also be of interest to control the peripheral equipment 10 arranged on the boat, such as position lights, capstan, bilge-pump. With the monitoring system, the boat's engine 8 can be controlled and information regarding the temperature of the engine 8, oil level, battery voltage, operating time etc. can be obtained.

Figure 2:
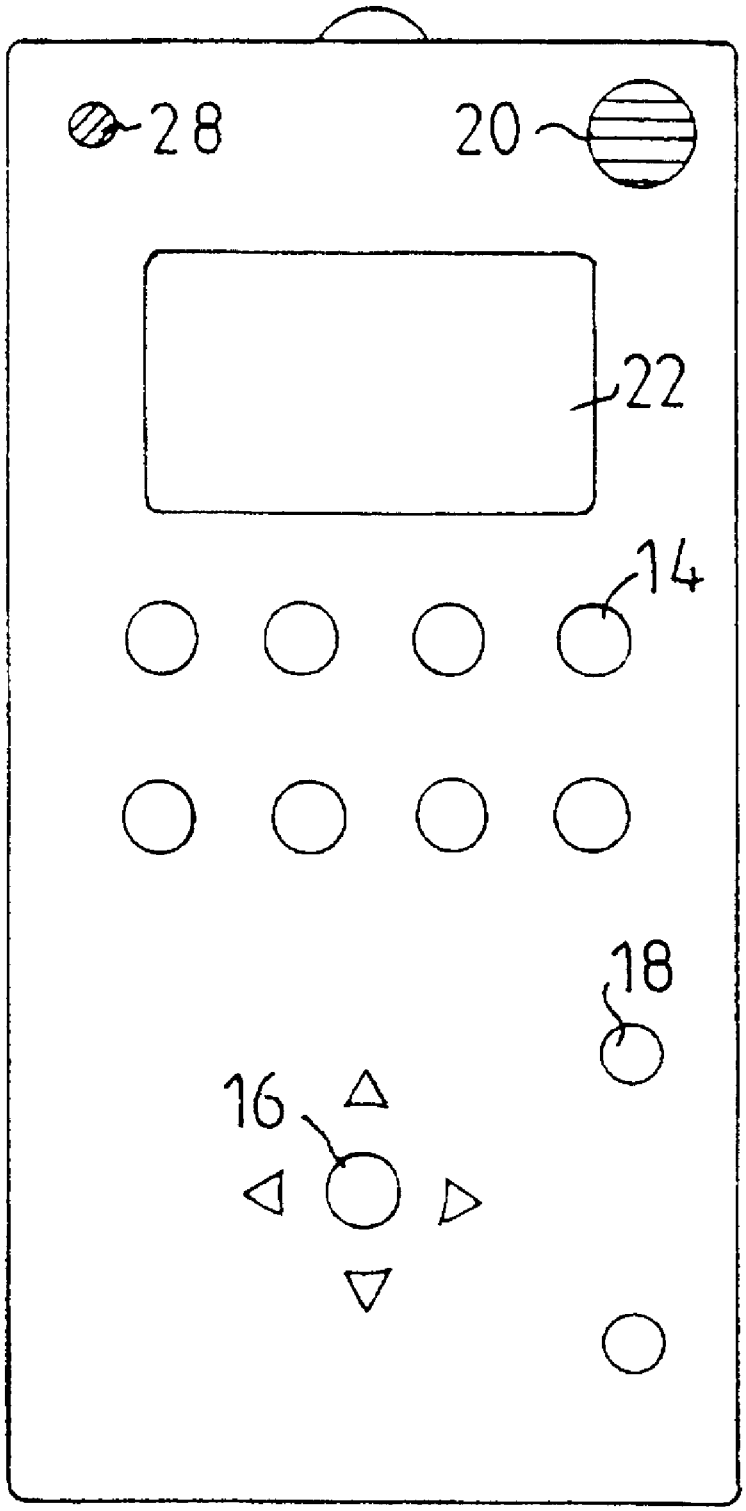
FIG. 2 shows schematically a portable manoeuvre unit with two-way communication according to the invention.

The monitoring system 1 also comprises a portable manoeuvre unit 12, which is so equipped that it can send wireless instructions to the central unit 2 installed on the boat and receive wireless information from the central unit 2. The portable manoeuvre unit 12 is shown in FIG. 2 and preferably has such dimensions that it can be accommodated in a breast-pocket or trouser-pocket. The portable manoeuvre unit 12 comprises functions for controlling the burglar alarm 4 arranged on the boat and/or the start-lock 6 for the engine 8. These functions can be activated and deactivated for example by means of the buttons 14 fitted on the manoeuvre unit 12. In order that the owner of the boat can receive information about a break in promptly, the portable manoeuvre unit is equipped so as to receive information from the burglar alarm 4.

The portable manoeuvre unit 12 also comprises functions to start the engine 8 of the boat and receive information about the conditions of the engine 8 plus functions for controlling the peripheral equipment 10 arranged on the boat. The portable manoeuvre unit 12 can also comprise means for manoeuvring, such as a joy-stick 16 or other manoeuvring device and the gear changing device 18 for wireless manoeuvring the boat. Thus, in this way the boat can be remotely controlled while mooring, etc. The information can be presented acoustically by means of a buzzer 20 arranged on the portable manoeuvre unit and visually by means of a display panel 22 arranged on the portable manoeuvre unit 12.

To increase the safety of the passengers and crew on board the boat, the portable manoeuvre unit 12 can be fitted with a man-overboard function 21 (FIG. 1) which is triggered if the portable manoeuvre unit 12 falls into the water or under the surface of the water. This man-overboard function 21 can be activated or when required be left activated continuously.

A land-based alarm centre 24 can be arranged, for example, at a boat club, and be equipped to receive, by radio from the central unit 2 on a boat, on the one hand information concerning events and conditions on the boat and/or components arranged on the boat, and on the other hand information about the position of the boat and/or distance from the alarm centre 24.

When the alarm is set and the boat is moored at the boat club, the central unit 2 arranged on the boat sends a message to the alarm centre 24 (FIG. 1) that no events are taking place and no conditions have been changed on the boat. This message can be sent, for example, every second. The alarm centre 24 at the boat club then registers that everything is normal on the boat. When the boat arrives at the boat club, an automatic registration signal is sent from the central unit 2 on the boat. The monitoring system 1 and consequently the burglar alarm 4 are activated by means of the portable manoeuvre unit 12.

Preferably the range between the alarm centre 24 at the boat club and the boat's central unit 2 is about 1000 metres. If an event, for example a break in, happens on the boat, the boat's central unit 2 sends information about this to the alarm centre 24 at the boat club. The alarm centre 24 can be connected, in a conventional way, to a telephone connection 26 so that the owner of the boat can be informed by telephone that a break in has occurred.

If the boat is towed away from the boat club, the amplitude of the carrier wave between the alarm centre 24 at the boat club and the boat's central unit 2 is progressively reduced. When the signal or message from the boat's central unit 2 can no longer be picked up by the alarm centre 24 at the boat club, the alarm centre 24 sends information to the owner of the boat that the boat is being stolen or removed from the boat club. Alternatively, the monitoring system can comprise equipment for radio locating of the boat's approximate position. If the boat's geographical position is changed an alarm is sounded. When the boat is moored at the boat club, the boat's central unit 2 can also send other alarms to the alarm centre 24 at the boat club, such as low battery voltage, need to pump the bilges, abnormal sounds, such as banging against the quay etc.

The alarm centre 24 at the boat club is preferably equipped so that it scans over the radio channels of a number of boats at the same time, which means that the alarm centre is in contact with the central units 2 a number of boats at the same time.

The portable manoeuvre unit 12 can function as an alarm receiver instead of the alarm centre 24 at the boat club. In this case, the manoeuvre unit has a built-in signal transmitter which sets off an alarm when something abnormal happens on the boat. The portable manoeuvre unit 12 then preferably has logic to indicate when the signal level is reduced because the manoeuvre unit 12 has been moved outside the range of the boat's central unit 2. The portable manoeuvre unit 12 can be placed in a charger (not shown) which has a socket for an external aerial in order to obtain a more reliable reception. With this charger, a set-off alarm can be forwarded by telephone or similar.

By fitting the portable manoeuvre unit 12 with a sensor 28 which detects if the portable manoeuvre unit 12 falls into or under water, the portable manoeuvre unit 12 can be used as safety equipment. This man-overboard function 21 means that an alarm signal can be received in the event that somebody who is carrying the portable manoeuvre unit 12 falls overboard and into the water. It is also possible for the boat's engine 8 to be stopped automatically when the portable manoeuvre unit 12 sends a signal to the boat's central unit 2 when the portable manoeuvre unit 12 falls into the water. For the man-overboard function 21 to work, this function must first be activated. Alternatively, the function can be active continuously. Preferably a number of smaller portable manoeuvre units 12 with a limited number of functions can be used at the same time on the same boat. Thus, everyone on board the boat can carry such a manoeuvre unit which comprises a man-overboard function 21.

The portable manoeuvre unit 12 can also operate in conjunction with the central unit 2 arranged on the boat so that the portable manoeuvre unit 12 continuously or frequently sends a signal or a message to the central unit 2 that no abnormal event is taking place. If, however, the portable manoeuvre unit 12 falls into the water, the signal or message is reduced or ceases, upon which the boat's central unit 2 registers that an abnormal event has taken place. As a result, an alarm is activated and/or the boat's engine 8 is stopped automatically. To obtain this function, the sensor 28 on the portable manoeuvre unit 12 can be made in the form of a pressure transducer which interrupts the signal when the pressure transducer registers a predetermined pressure as would be the case under water. Alternatively, a signal frequency is chosen which cannot be sent under water.

The portable manoeuvre unit can also be equipped with a function which corresponds to a dead man's handle. By letting the portable manoeuvre unit 12 emit a sound at predetermined intervals and requiring that these acoustic signals must be cancelled, acknowledgement that all is well with the person who cancels the signals is obtained. The predetermined intervals can be chosen individually.

In summary, it can be said that the portable manoeuvre unit 12 comprises both a radio transmitter and receiver for: activating a burglar alarm 4, activating a start-lock, activating operating instructions for the engine 8 and gearbox, starting the engine 8, changing gear between forward/neutral/reverse, throttle controls, analogue steering of the boat, starting and controlling bilge pumping, testing various alarm functions, turning on and off lamps and position lights, controlling the capstan and bow propeller, activating the man-overboard function 21, receiving alarms, cancelling alarms, activating a dead man's handle plus a number of additional functions.

The monitoring system 1 according to the invention can also be fitted with GSM and GPS functions by use of which information about the position of the boat can be obtained. If GSM is used, this system's SMS (text information) can be used, for example, for diagnosis, alarms etc. If the boat is stolen or towed away it is easy to find the boat by means of the GPS system.

As shown in FIG. 1, the components arranged on the boat are coupled to a digital serial bus 30 arranged on the boat in order to form a network 32. This network 32 can be a CAN-network which is commonly used in vehicles. The various components communicate with each other digitally via this network 32. Thus, for example, the boat's control panel 33 forms part of the network 32. The boat's engine 8 is preferably coupled to the network 32 via a control system 34, arranged for the engine 8, for example of the EDC type. An EDC system comprises an electronic control module 38 which is fitted with software to control the functions of the engine 8. By means of the monitoring system 1, the start-lock 6, which affects the EDC system, can be activated which results in making starting and operation of the engine 8 impossible.

What is claimed is:

1. A monitoring system for boats, comprising:

a central unit installed on the boat, said central unit being equipped to send wireless information concerning events and conditions on the boat and/or components arranged on the boat and to receive wireless instructions to control the components arranged on the boat, said central unit being coupled to manoeuvering apparatus on the boat having an engine with gears, a throttle control and a steering device;

a portable manoeuvre unit remote from said boat is equipped to send wireless instructions to the central unit installed on the boat and to receive wireless information from the central unit, the portable manoeuvre unit including a manoeuvering device and a gear changing device, the portable manoeuvre unit having means to send wireless instructions to change the gears between forward, neutral and reverse, to adjust the throttle control, and to control the steering device of the boat thereby to manoeuvre the boat.

2. A monitoring system according to claim 1, wherein the portable manoeuvre unit has an acoustic signal emitter for emitting a sound at predetermined intervals and which sound must be cancelled thereby affording an acknowledgement that all is well with an individual who cancels the sound.

3. A monitoring system according to claim 1, wherein the monitoring system is provided with GSM-functions, which send said information via SMS.

4. A monitoring system according to claim 1, wherein a digital serial bus forming a CAN-network is disposed in the boat and said central unit is connected to the CAN-network.

5. A monitoring system according to claim 4 including a diesel engine on the boat and having a control system of an EDC type on the boat, said control system being connected to the CAN-network.

6. A monitoring system according to claim 1, including a burglar alarm on the boat and a start-lock for the engine on the boat, said portable manoeuvre unit being equipped to receive information from the burglar alarm.

7. A monitoring system according to claim 1, including a starter for the engine on the boat and controlled by said portable manoeuvre unit to start the engine, said portable manoeuvre unit having wireless reception for receiving information about the conditions of the engine including at least one of engine temperature, oil level, battery voltage and operating time.

8. A monitoring system according to claim 1 wherein the portable manoeuvre unit, through wireless controls, controls one of position lights, a capstan, and a bilge-pump on the boat.

9. A monitoring system according to claim 1, wherein the portable manoeuvre unit includes means responsive to immersion in water to automatically stop an engine on the boat or activate an alarm signal.

10. A monitoring system according to claim 1, including a wireless land-based alarm center for receiving from the central unit information concerning events and conditions on the boat and/or components arranged on the boat, and information about the position of the boat or the distance of the boat from the alarm center.

* * * * *